US009157193B2

(12) United States Patent
Miguelez Tapia

(10) Patent No.: US 9,157,193 B2
(45) Date of Patent: Oct. 13, 2015

(54) METHOD FOR THE INSTALLATION OF SLAB TRACKS IN TWIN TUBE TUNNELS

(75) Inventor: Francisco Javier Miguelez Tapia, Madrid (ES)

(73) Assignee: FCC CONSTRUCTION, S.A., Madrid (ES)

( * ) Notice: Subject to any disclaimer, the term of this patent is extended or adjusted under 35 U.S.C. 154(b) by 416 days.

(21) Appl. No.: 12/815,487

(22) Filed: Jun. 15, 2010

(65) Prior Publication Data

US 2010/0320279 A1 Dec. 23, 2010

(51) Int. Cl.

| | |
|---|---|
| ***E01B 1/00*** | (2006.01) |
| ***E01B 29/02*** | (2006.01) |
| ***E01B 5/00*** | (2006.01) |
| ***E01B 2/00*** | (2006.01) |
| ***E01B 29/00*** | (2006.01) |

(52) U.S. Cl.
CPC ..... *E01B 1/002* (2013.01); *E01B 2/003* (2013.01); *E01B 29/005* (2013.01)

(58) Field of Classification Search
CPC ..... B23Q 17/00; B25F 9/00; B25F 1/00; B65G 67/00; E01B 25/28; E01B 11/00; E01B 19/00; E01B 2203/17; E01B 2203/01; E01B 2/003; E01B 2/00; E01C 9/00
USPC ..... 29/897.3, 897.34, 407.05, 407.09, 429, 29/527.1, 525.14; 238/2, 8, 27, 382, 283; 104/2; 414/339, 373, 529, 800
See application file for complete search history.

(56) References Cited

U.S. PATENT DOCUMENTS

| | | | | |
|---|---|---|---|---|
| 793,080 | A * | 6/1905 | Kimball | 104/26.1 |
| 3,382,815 | A * | 5/1968 | Yoshiro Higuchi et al. | 104/3 |
| 3,907,200 | A * | 9/1975 | Bernard | 238/7 |
| 4,080,903 | A * | 3/1978 | Cicin-Sain | 104/6 |
| 4,121,398 | A * | 10/1978 | Hahn et al. | 52/646 |
| 4,207,820 | A * | 6/1980 | Cicin-Sain | 104/2 |
| 4,827,848 | A * | 5/1989 | Kusel | 104/3 |
| 4,905,896 | A * | 3/1990 | Eisenmann et al. | 238/2 |
| 5,285,964 | A * | 2/1994 | Vanotti | 238/7 |
| 5,347,934 | A * | 9/1994 | Dunnett | 104/6 |
| 5,417,540 | A * | 5/1995 | Cox | 414/495 |
| 5,947,259 | A * | 9/1999 | Leisner et al. | 198/465.3 |
| 6,616,061 | B1 * | 9/2003 | Penny | 238/7 |
| 6,913,717 | B2 * | 7/2005 | Sayadi et al. | 264/33 |
| 6,954,974 | B2 * | 10/2005 | Rada | 29/423 |
| 8,006,624 | B2 * | 8/2011 | Sin | 104/2 |
| 2002/0044831 | A1 * | 4/2002 | Leone et al. | 404/104 |
| 2003/0168834 | A1 * | 9/2003 | Ulrich | 280/727 |
| 2007/0057407 | A1 * | 3/2007 | Schildmeijer | 264/333 |
| 2007/0246559 | A1 * | 10/2007 | Hohne et al. | 238/345 |
| 2008/0230520 | A1 * | 9/2008 | Lichtberger et al. | 219/53 |
| 2010/0001088 | A1 * | 1/2010 | Reichel et al. | 238/7 |

FOREIGN PATENT DOCUMENTS

| | | | | |
|---|---|---|---|---|
| DE | 2619504 A | * | 11/1977 | E01B 29/02 |
| DE | 3809466 A1 | * | 9/1989 | |
| DE | 10248037 B3 | * | 5/2004 | |
| EP | 0898016 A2 | * | 2/1999 | |

OTHER PUBLICATIONS

Reinke et al., Twin-tube, Single-track High Speed Rail Tunnels and Consequences for Aerodynamics, Climate, Equipment and Ventilation, Aug. 25, 2004, www.hbi.ch, pp. 1-15.*
Reinke et al., Twin-Tube, Single-Track High-Speed Rail Tunnels and Consequences for Aerodynamics, Climate, Equipment and Ventilation, Aug. 25, 2004, HBI Haerter Ltd., www.hbi.ch, pp. 1-15.*
Translated EP-0898016-B1.*
Translated DE-10248037-B3.*
Tanslated DE-3809466-A1.*

* cited by examiner

*Primary Examiner* — David Bryant
*Assistant Examiner* — Jun Yoo
(74) *Attorney, Agent, or Firm* — Sturm & Fix LLP

(57) ABSTRACT

A method is described for the installation of slab tracks in tunnels, in particular tracks on a slab of concrete, with the optimized design and execution characteristics, and substantially increased performance compared to the normal known methods. The method includes a succession of phases executed in order, with the help of an auxiliary track, Consisting of the design of the construction section, the construction of the railway yards, assembly of the auxiliary track from the evacuation platform, execution of the foundation base, assembly of the track in slabs, transitions from slab track—ballast track, and placement of long bars and welding.

1 Claim, No Drawings

METHOD FOR THE INSTALLATION OF SLAB TRACKS IN TWIN TUBE TUNNELS

CROSS REFERENCE TO RELATED APPLICATIONS

This application claims priority of ES Application No. P200901421 filed Jun. 16, 2009, which is incorporated by reference herein in its entirety.

OBJECT OF THE INVENTION

This present invention relates to a method for the installation of slab tracks in twin tube tunnels, that contributes essential characteristics of novelty and appreciable advantages compared to the other known and used methods used for the same purposes in the current state of the art.

More specifically, the invention proposes the development of a method defined by a succession of consecutive phases or stages for the installation of slab tracks on the inside of a tunnel, each one of these phases being designed in an optimised manner in so far as their construction, execution and performance characteristics, with the introduction of adapted mini trains that move along an auxiliary side track which goes along the areas in which work is being carried out without directly interfering with them.

The field of application of the invention is the industrial sector involved in the installation of railways in general, and concrete slab tracks in particular.

BACKGROUND AND SUMMARY OF THE INVENTION

As is well known by skilled persons in this field, slab tracks, or tracks on a slab of concrete, are a type of railway track that sits on concrete or asphalt beds, these materials replacing the conventional ballast. The criteria for their construction are much more demanding than those of traditional track, as they require greater precision in so far as refers to the levelling, alignment and track width, as any subsequent correction of possible mistakes is very expensive. Along these lines, it is particularly important to provide effective drainage so as to eliminate possible future maintenance problems, as in traditional tracks it is the ballast that guarantees this drainage function.

Slab tracks have the disadvantage compared to traditional tracks, that the construction cost is higher than for the latter, but on the other hand, they have a series of significant advantages compared to traditional tracks, from various points of view: On one hand, they guarantee the correct positioning of each one of the elements that make up the track, such as the rails and sleepers, keeping the geometric parameters unchanged over time, and on the other hand, require less maintenance work than traditional tracks, with a reduction which according to some estimates is in the order of some 20% less, which thus allows the intervention times to be reduced and, consequently, increases the operating availability of the infrastructure.

In addition, slab tracks also have some other positive aspects amongst which the following can be mentioned as examples: greater safety and reliability of their performance and repair in case of derailments, which in turn are less probable owing to the fact that slab tracks have two defences: One active, that reduces the formation of transversal defects, which translates into greater train stability, and another that is passive, based on its robustness, which makes it more solid from a structural point of view.

In accordance with the known methods of construction, the slab track can either have embedded rails, that is, the rail is introduced onto the inside of a channel made in the concrete slab, in such a way that the rail is supported along its entire length with the resulting reduction of stress and a better distribution of the loads, both static and dynamic, or with the rail assembled on sleepers. In whichever case, the parts that can be highlighted on a slab track are as follows:

- Main slab: Is made up of concrete and the rails are fastened onto it.
- Elastomeric product: This is a rubber based product that is placed between the rail and the main slab, in such a way that the assembly made up of the main slab and the elastomer perform functions equivalent to those of the ballast and the sleepers on conventional tracks.
- Base slab: Located between the main slab and the platform, its object is to distribute the pressures equally on the platform and are usually some 15 centimeters in thickness.
- Platform: Conceived and carried out in such a way as to provide good drainage capacity:
- Sleepers: As has been said, they are only used in some types of slab tracks, and
- Rail: Of the same type as in conventional tracks, but with reduced cross section.

The above is a summarised exposition of the differing components that are used in the construction of a slab track, together with some performance characteristics of same.

Given the high number of advantages gained from the installation of slab tracks compared to conventional tracks on ballast, it is desirable to be able to have the methods available that allow the assembly to be used in those cases in which its use is advisable, or which are suitable for whatever circumstance. This present invention has been developed taking the above need into consideration, and to that end is aimed at providing an installation method for slab tracks on the inside of tunnels that improves the traditional methods, where the space available is much more limited than on open land, and because of this a process sequence has been developed by means of which solutions are provided for the differing construction phases. This sequence of process stages constitutes the essence of the invention method, and is going to be described in greater detail below:

DESCRIPTION OF A PREFERRED EMBODIMENT

As has been mentioned above, the detailed description of the slab track installation method is going to be described below with the particular application of the case of a twin tube tunnel, this means, a tunnel made up of two separate tubes with each one of them having a single track. The explanation is made on the basis of one of the tubes, it being identical for the case of the second tube.

According to the method developed for the invention, the installation of the slab track includes the following stages:

1. Formation of the construction section
2. Design and construction of the railway yards
3. Assembly of auxiliary track in the maintenance lane
4. Stocking of the sleepers on the evacuation platform
5. construction of the foundation base
6. Assembly of the slab track
7. Slab track transitions—ballast
8. Provision of long bars and welding Next the characteristics that distinguish each one of the different stages are explained.

1. Formation of the Construction Section

The construction section has been designed in such a way that it is constructed with two platforms, one on each side, between which the foundation base is located as well as the slab track. The free horizontal width is much reduced, thus preventing the simultaneous movement of lorries and other mechanical devices, which means lengthy cycles and therefore has a negative influence on final performance. For this reason, the invention has envisaged the use of mini-trains adapted to the production needs associated to each one of the process phases, and capable of moving along an auxiliary track, built for this purpose, simultaneous to the carrying out of each one of the cited phases, described below. The construction sections are apt to have variations and can include a narrow maintenance lane, a wide maintenance lane, or a very wide conventional platform, in accordance with the needs of the differing places along the tunnel.

2. Railway Yards

In accordance with a second stage of the invention method, a place is specified for the construction of a railway yard, this being a basic characteristic for the logistical development of the works to be carried out. The railway yard has a number of tracks that is sufficient for the fulfillment of the activities of loading and unloading materials, likewise control centre and workshops.

3. Assembly of an Auxiliary Track in the Maintenance Lane

As stated above, the assembly of an auxiliary track to provide services in regard to the differing activities that are being carried out, extended beyond the areas in which work is being carried out, can be undertaken along the maintenance lane simultaneous to the construction of the railway yard described in the previous section. Because of this, the drilling of the platform and the placement of the pins is carried out in the places in which later the retention bolts of the auxiliary track will be placed. In addition, at certain pre-determined distances (e.g. every 3.5 km in the case of a preferred practical embodiment in accordance with the invention), a siding will be made for the purpose of marshalling the movements and forward point of the different activities that are being carried out in an overlapping manner. The rails for the construction of the railway lines can be transported up to the assembly point by means of trailer-cranes or with mini trains, depending on the situation of the works, moveable along the stated auxiliary line.

4. Stocking of the Sleepers on the Evacuation Platform

This activity precedes the laying of the concrete of the foundation base transported by the concrete mini train, which requires more movements than the sleeper mini train, as the latter transports a limited number of sleepers on each trip. The operation consists of the sleeper mini train being stationed in front of the concrete mini train, and with the help of mini back loader type of machine, the sleepers are stockpiled and are distributed in batches, for their subsequent use in the assembly phase of the slab laying.

5. Construction of the Foundation Base

After this, the pouring of the concrete and its spreading with vibrating bars and vibrators is proceeded with by means of the concrete mini train so as to achieve a uniform and exact level that complies with the standards that are applicable to the case.

6. Assembly of the Slab Track

It is necessary to have a predetermined length of the auxiliary track for the carrying out of this stage, in accordance with the final performance required and provided that the logistical system so permits.

The stage comprises several phases of activity, which are as follows:

6.1: Distribution of the sleepers in the foundation base 6.2: Reinforcing of the track and $1^{st}$ levelling 6.3: $2^{nd}$ levelling 6.4: Concreting 6.5: Advance of the assembly line or track layout 6.1: Distribution of the Sleepers on the Foundation Base:

The operation for the distribution of the sleepers consists of carrying out the consecutive distribution of the sleepers, in an equidistant manner, along the tunnel and at a distance as stated in the project. The process includes locating the mark points on the platform, and to carry out the setting out of an axis that can be used for the correct alignment of the sleepers, meanwhile a mini-back loader, provided with a carrying platform, carries out the distribution of the sleepers, for example 4 by 4, that have previously been distributed along the platform.

6.2: Reinforcing of the Track and $1^{st}$ Levelling:

Next, with the sleepers positioned on the foundation base, the reinforcing operation of the track and the $1^{st}$ levelling is carried out. To do this, the placement of the track proceeds with the help of the mini-train which moves along the length of the auxiliary track, with a capacity for a specified number of rails depending on the length of same, and fitted with a number of synchronised gantries, for example, 8 gantries in a preferred embodiment. After this, the square setting of the sleepers is proceeded with, subsequently fastening the rails, and fixing the sleepers with an adequate predetermined torque so as to ensure the contact of the rail with the sleepers, but without reaching values that would put the integrity of the pins in jeopardy.

After this, the placement of levelling members and the hydraulic aligners-levellers is proceeded with and the positioning is carried out along the stretches of track at predetermined lengths, adjusting the marking points, leaving the track held down with the screws of the levelling tackle.

6.3: Second Levelling

This levelling and alignment constitutes the adjustment and checking process for the track handed over by the assembly team. It is the waiting time for the concreting of same.

With the topographical equipment, for example digital topographical equipment, which progressively moves along the railway track the final adjustment is made. The equipment includes an automated tachymeter with a measuring carriage that has a computer by means of which the geometry of the track is analysed in real time. Tools such as ratchet braces and alignment spanners are used to reposition the track.

6.4: Concreting of the Slab Track

Once having finished the already described levelling operations, the following phase of the process consists of the concreting of the track, carried out from the position of the auxiliary track, in order to do this in the first place to duly protect both the track and equally the fixings; next to carry out the pouring of the concrete by pipe or by distribution and vibration, and finally, the trowelling and cleaning operations of the sleepers and the fixings.

6.5: Advance of the Assembly Line or Track Layout

After the concrete poured in the previous phase has gone off, the dismantling of the levelling tackle is carried out and the unhitching of the auxiliary track, for the purpose of loading it on the mini-train which has to transport it to the distribution of sleepers phase, once again starting the cycle.

7. Transitions of Slab Track—Ballast

Depending on the variation of the rigidity required, thus will be the length and the types of sleepers and the fixings to be used.

Along general lines, the connection of the track on ballast slabs is carried out by means of the construction of a small trough slab, for example of the length of around some 10 meters, that confines the ballast and alters the thickness depending on some predetermined values, for example, 20 to 35 cms under the sleeper. Prior to the trough, in the area of the concreted track, double fix sleepers are placed, just the same as with the trough, so as to place two fastening members.

8. Provision of Long Bars and Electric Welding

The long bars can have variable lengths from 60 to 90 meters, or others depending on the limitations for each particular application. They are normally transported along the railway track by the mini-train, with two possibilities for unloading: Mini train with side unloading, or equally with conventional unloading mini train moving in reverse.

In so far as the welding, electric welding is preferred, although other suitable welding techniques are acceptable.

As will be understood, the installation process of slab tracks for use in railway tunnels that has been described above, optimises the different construction phases of the process, and allows for a considerable increase in the performance of the method up to production values that are very much higher than those for the normal methods in the current state of the art.

It is not considered necessary to make the contents of this present description more extensive in order for a skilled person in this field to be able understand its scope and the advantages that arise from same, likewise how to carry out the practical embodiment of its aim.

In spite of the above, and given that the description made corresponds solely to one example of a preferred embodiment, it will be understood that within the essence of said embodiment there may be introduced multiple modifications and variations of detail, likewise comprised within the scope of the invention, and that will be able to affect characteristics related to different phases of the process provided that it does not alter any of the basic principles of the invention, in accordance with that which has already been described and in accordance with that which is defined in the claims that follow.

The invention claimed is:

1. Method for the installation of slab tracks in twin tube tunnels aimed at carrying out an installation of a single track on slabs in each tunnel tube of a twin tube tunnel, comprising a series of working stages carried out in sequential order in each one of the tunnel tubes, and which comprises:

(a) determination of a construction section wherein the construction section is designed in such a way that it has two platforms that set side borders of a foundation base, with a reduced maximum width, but which is enough to allow use of mini-trains, capable of moving on auxiliary tracks, adapted to the production needs during development of each one of the working stages;

(b) construction of a railway yard to facilitate supply of materials to the construction section wherein the carrying out of the construction of the railway yard stage is implemented on an area that is sufficient to include a variable number of tracks, this number of tracks being enough to allow all of material loading and unloading operations to be carried out;

(c) assembly of an auxiliary track in a maintenance platform in the twin tube tunnels wherein carrying out of assembly of an auxiliary track is carried out from the maintenance platform, simultaneously with the construction of the railway yard, for which drilling is carried out in the maintenance platform intended for the placement of pins in positions in which fixing retention bolts to the auxiliary track will be applied later, with provision of track sidings in one or more points set at pre-determined distances from each other;

(d) stocking sleepers on an evacuation platform wherein stocking sleepers on the evacuation platform is carried out prior to an operation of pouring concrete of the foundation base, with the help of a sleeper mini-train for the transporting of concrete, and by means of a mini-backload machine that is used for carrying and distribution of the sleepers in batches;

(e) construction of a foundation base wherein the construction of a foundation base is carried out by means of a concrete mini-train, with which pouring of concrete is carried out to be spread with vibrating levels and vibrators so as to achieve a uniform and exact level that complies with tolerances established by standards that are applicable;

(f) assembly of the slab track wherein the assembly of the slab track is carried out by means of a succession of sub-stages comprising: distribution of sleepers on the foundation base, reinforcing of track and first leveling, second leveling, concreting and advancement of bar assembly or rail laying; wherein the distribution of the sleepers on the foundation base comprises equidistant distribution of sleepers along a length of the tunnel maintaining a predetermined separation, with the help of a support axis to align the sleepers obtained from points marked on a platform, and in which the distribution of the sleepers is carried out with the use of a back loader of machine; wherein the assembly of the slab track and leveling comprises placement of rails on the sleepers positioned on the foundation base, by means of a mini-train, and the subsequent operations for placement and squaring of the sleepers, fastening of the rails and tightening of the sleepers, after which the placement of leveling members and the adjustment of the track by sections in regard to marker points; wherein the second leveling implements an adjustment and verification phase of the track handed over by an assembly team, and it is carried out by means of topographical equipment that includes a robot tachymeter together with a measuring trolley carrying a computer that analyses geometry of the track in real time; wherein the concreting includes an operation for covering of rails and fixings, an operation for pouring of concrete by pipe or by means of distribution and vibration, and an operation for trowelling and cleaning of the sleepers and fixings; and wherein the advancement of the bar assembly or rail laying is carried out after concrete has been placed, and to do this unhitching of the auxiliary track is proceeded with after removing leveling devices, with track being loaded on a mini-train for transportation to a new phase of sleeper distribution, for starting of a new cycle;

(g) construction of a trough slab for confining ballast to facilitate transition from a track on slab to a track on ballast wherein the construction of the trough slab confines ballast under the sleeper, and is placed before laying of the trough slab in an area which has received concrete and sleepers with double fastening for location of fastening members; and (h) placement of long bars and welding to an adjacent long bar; wherein the placement of the long bars and welding is carried out with a mini-train used to transport bars of a predetermined length and unloading the bars with the train operating backwards.

* * * * *